US007513405B2

(12) United States Patent
Kishi et al.

(10) Patent No.: US 7,513,405 B2
(45) Date of Patent: Apr. 7, 2009

(54) STAPLE REFILL WITH BACKWARD MOVEMENT PREVENTING MEMBER

(75) Inventors: Kazuhiko Kishi, Tokyo (JP); Toshio Shimizu, Tokyo (JP); Kazuo Higuchi, Tokyo (JP)

(73) Assignee: Max Kabushiki Kaisha, Chuo-Ku, Tokyo (JP)

( * ) Notice: Subject to any disclaimer, the term of this patent is extended or adjusted under 35 U.S.C. 154(b) by 163 days.

(21) Appl. No.: 10/569,267

(22) PCT Filed: Aug. 27, 2004

(86) PCT No.: PCT/JP2004/012774

§ 371 (c)(1),
(2), (4) Date: Mar. 30, 2006

(87) PCT Pub. No.: WO2005/021218

PCT Pub. Date: Mar. 10, 2005

(65) Prior Publication Data

US 2007/0009705 A1 Jan. 11, 2007

(30) Foreign Application Priority Data

Aug. 29, 2003 (JP) ..... 2003-308099

(51) Int. Cl.
*B27F 7/38* (2006.01)
*B25C 5/16* (2006.01)
*B65D 85/24* (2006.01)

(52) U.S. Cl. ..... 227/120; 206/340; 227/136

(58) Field of Classification Search ..... 206/340; 227/119–137, 138
See application file for complete search history.

(56) References Cited

U.S. PATENT DOCUMENTS 2,946,059 A * 7/1960 Wandel ..... 227/136

(Continued)

FOREIGN PATENT DOCUMENTS

EP 0845337 6/1998

(Continued)

OTHER PUBLICATIONS

European Search Report from corresponding European Application No. EP04772723, mailed Aug. 22, 2008.

*Primary Examiner*—Bryon P Gehman
(74) *Attorney, Agent, or Firm*—Buchanan Ingersoll & Rooney PC

(57) ABSTRACT

A staple refill which can be stored in a refill storing section in such a manner that the leading one of the sheet-like joined staples wound in roll form is on the upper side and which is adapted to lessen the load on a feeding mechanism for feeding the leading one of the sheet of joined staples in a stapler main body. The staple refill is removably attached to a cartridge installed in a stapler main body. A refill includes a storing section for storing a sheet of joined staples wound in roll form, a discharge port for discharging the sheet of joined staples, and a lead-out passage for leading out the leading part of the sheet of joined staples into the discharge port. The lead-out passage is upwardly bent from the discharge port toward the interior of the storing section, so that the leading part positioned on the upper side of the sheet of joined staples is lead out to the discharge port. The lead-out passage is provided with a retrograde motion preventive member which prevents movement of the sheet of joined staples to the storing section.

18 Claims, 10 Drawing Sheets

U.S. PATENT DOCUMENTS

| | | | | |
|---|---|---|---|---|
| 3,009,618 | A * | 11/1961 | Lerner | 227/120 |
| 4,949,893 | A * | 8/1990 | Heckathorn | 227/120 |
| 4,978,045 | A | 12/1990 | Murakami et al. | |
| 5,794,833 | A * | 8/1998 | Strååt | 227/120 |
| 6,039,230 | A * | 3/2000 | Yagi et al. | 227/120 |
| 6,050,471 | A * | 4/2000 | Yagi | 227/119 |
| 6,223,965 | B1 | 5/2001 | Nakatsuka | |
| 6,371,351 | B1 * | 4/2002 | Magnusson | 227/119 |
| 6,371,352 | B1 | 4/2002 | Mochizuki | |
| 6,641,023 | B2 * | 11/2003 | Strååt et al. | 227/121 |
| 6,899,259 | B2 * | 5/2005 | Takeuchi et al. | 227/120 |
| 6,913,181 | B2 * | 7/2005 | Mochizuki et al. | 227/120 |
| 7,017,789 | B2 * | 3/2006 | Mochizuki et al. | 227/119 |
| 7,377,414 | B2 * | 5/2008 | Kishi et al. | 227/120 |
| 2006/0054653 | A1 * | 3/2006 | Hasegawa et al. | 227/120 |

FOREIGN PATENT DOCUMENTS

| | | |
|---|---|---|
| EP | 1175979 | 1/2005 |
| JP | 1-130902 | 5/1989 |
| JP | 9-136271 | 5/1997 |

* cited by examiner (a)

(b)

(c)

STAPLE REFILL WITH BACKWARD MOVEMENT PREVENTING MEMBER

This disclosure is based upon Japanese Application No. 2003-308099 filed Aug. 29, 2003 and International Application No. PCT/JP2004/012774, filed Aug. 27, 2004, the contents of which are incorporated herein by reference.

FIELD OF THE INVENTION

The present invention relates to a staple refill in which a sheet-like connected staple wound in a roll shape is stored.

BACKGROUND OF THE INVENTION

For example, as disclosed in Japanese patent Application Laid-Open No. H9-136271 (Patent Reference 1), the conventional staple refill in which the sheet-like connected staple wound in a roll shape is stored has a refill which is detachably attached to a stapler main body or a cartridge provided in the stapler main body. The refill includes a storage portion in which the sheet-like connected staple is stored, a discharge port which discharges the sheet-like connected staple stored in the storage portion, and a delivery passage which delivers a leading end portion of the sheet-like connected staple stored in the storage portion to the discharge port. The delivery passage is formed in a substantially linear shape, and is formed along a lower surface in the storage portion. A metal backward movement preventing member which is formed independently of the refill is attached to an upper portion of the delivery passage. In the sheet-like connected staple, many linear staples are arrange in a crosswise direction while being in contact with one another, and a bonding agent is applied to an upper surface to couple the staples in a band shape. Further, the sheet-like connected staple are caused to adhere in the center of the upper surfaces in the lengthwise direction by an adhesive tape, which prevents the linear staple from being separated. The sheet-like connected staple is wound in a roll shape while the upper surface faces the outside, and the sheet-like connected staple is stored in the staple refill.

In the conventional staple refill in which the sheet-like connected staple wound in a roll shape is stored, the sheet-like connected staple is stored in the storage portion of the refill such that a leading end portion of the sheet-like connected staple is located in a lower portion of the storage portion, and the leading end portion of the sheet-like connected staple is linearly stretched along the lower surface of the storage portion and the delivery passage. When the leading end portion of the sheet-like connected staple is delivered from the discharge port by feeding means such as a feeding pawl or a feeding roller provided in the stapler main body or the like, the whole sheet-like connected staple is placed on a drawn-forth portion which is linearly drawn. Therefore, there is a problem that a weight of the sheet-like connected staple is applied to the feeding means as a load. In drawing forth the sheet-like connected staple, because the whole sheet-like connected staple is moved forward, the sheet-like connected staple abuts on an inner surface of the storage portion, and the larger-than designed load is applied to the feeding means due to friction action, which results in the problem that it is difficult for the feeding means to feed the leading end portion of the sheet-like connected staple.

In the conventional staple refill, the backward movement preventing member slides on the drawn-forth portion which is linearly drawn. When the sheet-like connected staple is drawn forth on the discharge port side, the backward movement preventing member is bent in the discharge port, and the drawing-forth of the sheet-like connected staple is not obstructed. On the contrary, when the sheet-like connected staple is drawn back toward the storage portion side, the backward movement preventing member is latched in a connecting recess portion between the staples of the sheet-like connected staple, which prevents the drawing-back of the sheet-like connected staple. Thus, the backward movement preventing member always slides on the sheet-like connected staple. However, when contact pressure is excessively strong in the slide, the load applied onto the feeding means for feeding the sheet-like connected staple is increased. On the other hand, when the contact pressure is excessively weak in the slide, drawing-back resistance of the sheet-like connected staple is decreased. Therefore, there is the problem that the backward movement preventing member is difficult to adjust.

The feeding means is pressed to latch the lower surface of the sheet-like connected staple, and the sheet-like connected staple is fed forward. As described above, the bonding agent is applied to the upper surface and the adhesive tape adheres to the center of the upper surface toward the lengthwise direction. In the conventional staple refill, the backward movement preventing member slides on the upper surface of the sheet-like connected staple to which the bonding agent is applied. Therefore, the backward movement preventing member does not behave well in some cases because the backward movement preventing member slips. Further, the backward movement preventing members slide on both sides of the sheet-like connected staple across the adhesive tape, and there is a possibility that the sheet-like connected staple is bent when one of the backward movement preventing members does not behave well. There is also the problem that both the backward movement preventing members are difficult to adjust so as to behave well in the same manner. Further, because the backward movement preventing member is produced independently of the refill, the a labor hour is required to attach the backward movement preventing member to the refill, and the adjustment is required in the attachment of the backward movement preventing member as described above. Therefore, there is the problem that the backward movement preventing member cannot easily be installed in the refill. In the conventional staple refill, because the backward movement preventing member made of a metal material is installed, it is necessary to separate the backward movement preventing member into each material in disposal, which results in the problem that the disposal of the backward movement preventing member becomes troublesome.

In the conventional staple refill, when the sheet-like connected staple wound in a roll shape is stored in the storage portion of the refill, the whole outer surface of the sheet-like connected staple is stored while being in contact with a bottom surface of the storage portion. When the sheet-like connected staple is drawn toward the discharge port side, because the whole outer surface of the sheet-like connected staple is rotated while sliding on the bottom surface of the storage portion, the frictional resistance is increased, which results in the problem that the load applied onto the feeding means for feeding the sheet-like connected staple becomes large.

In the conventional staple refill, the sheet-like connected staple wound in a roll shape is stored in the storage portion of the refill, and the sheet-like connected staple is oscillated in the storage portion during transportation, which results in the possibility that the sheet-like connected staple wound in a roll shape is released. Further, in the opaque refill, the inside of the refill cannot be seen, which results in the problem that a state of the sheet-like connected staple and a remaining amount of sheet-like connected staple cannot be confirmed.

In view of the foregoing, a first object of the invention is to provide a staple refill, in which the sheet-like connected staple wound in a roll shape can be stored in the storage portion of the staple refill while the leading end portion of the sheet-like connected staple is located in the upper portion of the storage portion and the load applied onto the feeding means of the stapler main body can be decreased because the sheet-like connected staple is not placed on the drawn-forth portion which is drawn and fed. A second object of the invention is to provide a staple refill, in which the delivery passage is curved upward from the discharge port toward the inside of the storage portion, the backward movement preventing member is formed in the delivery passage, the backward movement preventing member is inclined downward to weaken the latching force when the sheet-like connected staple is fed, and the backward movement preventing member is inclined upward to strengthen the latching force when the sheet-like connected staple is drawn back, and thereby the adjustment of the backward movement preventing member is not required.

A third object of the invention is to provide a staple refill, in which the backward movement preventing member slides not on the upper surface of the sheet-like connected staple where the bonding agent is applied and the adhesive tape adheres, but on the lower surface of the sheet-like connected staple with which the feeding means of the stapler main body is made in contact, the sheet-like connected staple can securely be latched, the backward movement preventing member can slide in the center of the sheet-like connected staple, and thereby the possibility that the sheet-like connected staple is fed while being bent is eliminated. A fourth object of the invention is to provide a staple refill, in which because the backward movement preventing member is integrated with the staple refill, the labor hour for attaching the backward movement preventing member to the staple refill is eliminated, and the staple refill can easily be assembled.

A fifth object of the invention is to provide a staple refill, in which a projection strip sliding on the outer surface of the sheet-like connected staple wound in a roll shape is provided in the storage portion of the staple refill, a contact area with the outer surface of the sheet-like connected staple is lessened to decrease the frictional resistance, and thereby the rotation of the sheet-like connected staple can be smoothed. A sixth object of the invention is to provide a staple refill in which there is formed an opening that can be utilized in order to press the sheet-like connected staple stored in the storage portion of the staple refill so as not to move and that allows for confirmation of the inside the storage portion.

SUMMARY OF THE INVENTION

In order to solve achieve the object, there is provided a staple refill according to a first aspect of the invention which is detachably attached to a stapler main body or a cartridge provided in the stapler main body, the staple refill including a storage portion in which a sheet-like connected staple wound in a roll shape is stored, a discharge port which discharges the sheet-like connected staple stored in the storage portion, and a delivery passage which delivers a leading end portion of the sheet-like connected staple stored in the storage portion to the discharge port, wherein the delivery passage is curved upward from the discharge port toward an inside of the storage portion; the delivery passage delivers the leading end portion to the discharge port, the leading end portion being located in an upper side of the sheet-like connected staple; and a backward movement preventing member is provided in the delivery passage, the backward movement preventing member preventing movement of the sheet-like connected staple toward the storage portion side.

In order to solve achieve the object, there is provided a staple refill according to a second aspect of the invention wherein the backward movement preventing member is integrated with the staple refill.

In order to solve achieve the object, there is provided a staple refill according to a third and fourth aspect of the invention wherein the backward movement preventing member is formed such that a leading edge slides on the lower surface side of the sheet-like connected staple to latch a connecting recess portion between staples.

In order to solve achieve the object, there is provided a staple refill according to a fifth aspect of the invention wherein the delivery passage includes a first guide passage and a second guide passage, the first guide passage communicated with the discharge port and being formed in a substantially linear shape, the second guide passage communicated with the storage portion and being curved upward; and the backward movement preventing member is provided in the second guide passage.

In order to solve achieve the object, there is provided a staple refill according to a sixth aspect of the invention wherein the delivery passage includes an upper guide surface and a lower guide surface, the upper guide surface guiding an upper surface of the sheet-like connected staple, the lower guide surface guiding a lower surface of the sheet-like connected staple; the upper guide surface of the second guide passage is coupled to an inner surface of the storage portion; and the lower guide surface of the second guide passage is formed by a curved surface on the discharge port side, the curved surface projected toward an inside of the storage portion and being included in a guide projection portion.

In order to solve achieve the object, there is provided a staple refill according to a seventh aspect of the invention wherein the backward movement preventing member is formed so as to be projected from a surface on the discharge port side of the guide projection portion.

In order to solve achieve the object, there is provided a staple refill according to a eighth aspect of the invention wherein the surface on the discharge port side of the guide projection portion is formed in a curved shape so as to guide the sheet-like connected staple stored in the storage portion.

In order to solve achieve the object, there is provided a staple refill according to a ninth aspect of the invention which is detachably attached to a stapler main body or a cartridge provided in the stapler main body, the staple refill including a storage portion in which a sheet-like connected staple wound in a roll shape is stored, a discharge port which discharges the sheet-like connected staple stored in the storage portion, and a delivery passage which delivers a leading end portion of the sheet-like connected staple stored in the storage portion to the discharge port, wherein a backward movement preventing member is provided in the delivery passage, the backward movement preventing member preventing movement of the sheet-like connected staple toward the storage portion side; and a projection strip is provided in an inner surface of the storage portion, the projection strip sliding on an outer surface of the sheet-like connected staple wound in a roll shape to smooth rotation of the sheet-like connected staple.

In order to solve achieve the object, a staple refill according to a tenth aspect of the invention which is detachably attached to a stapler main body or a cartridge provided in the stapler main body, the staple refill including a storage portion in which a sheet-like connected staple wound in a roll shape is stored, a discharge port which discharges the sheet-like connected staple stored in the storage portion, and a delivery passage which delivers a leading end portion of the sheet-like connected staple stored in the storage portion to the discharge port, wherein a backward movement preventing member is provided in the delivery passage, the backward movement preventing member preventing movement of the sheet-like connected staple toward the storage portion side; and an opening communicated with the storage portion is formed in the staple refill.

DETAILED DESCRIPTION OF THE PREFERRED EMBODIMENT

Figure 1:
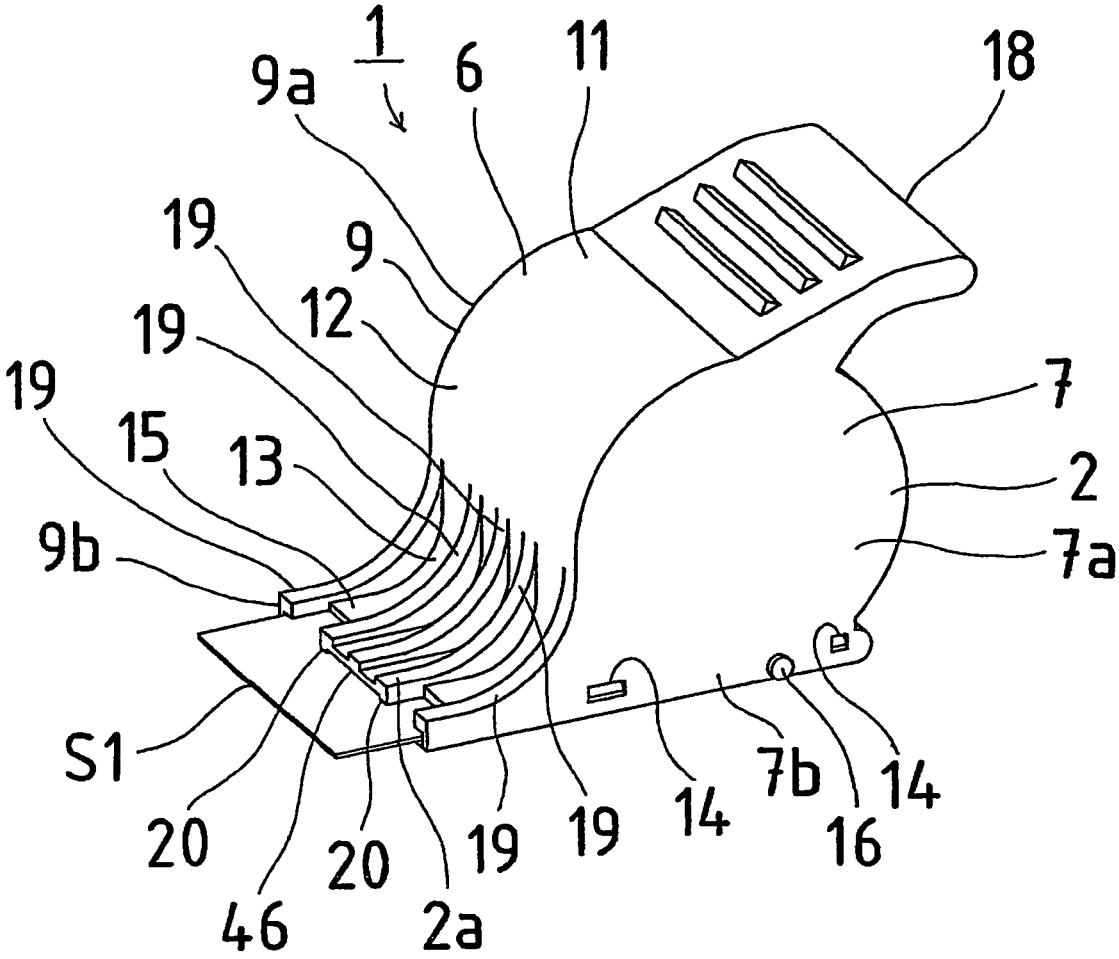
FIG. 1 is an overall perspective view showing an embodiment of a staple refill according to the invention.
Figure 2:
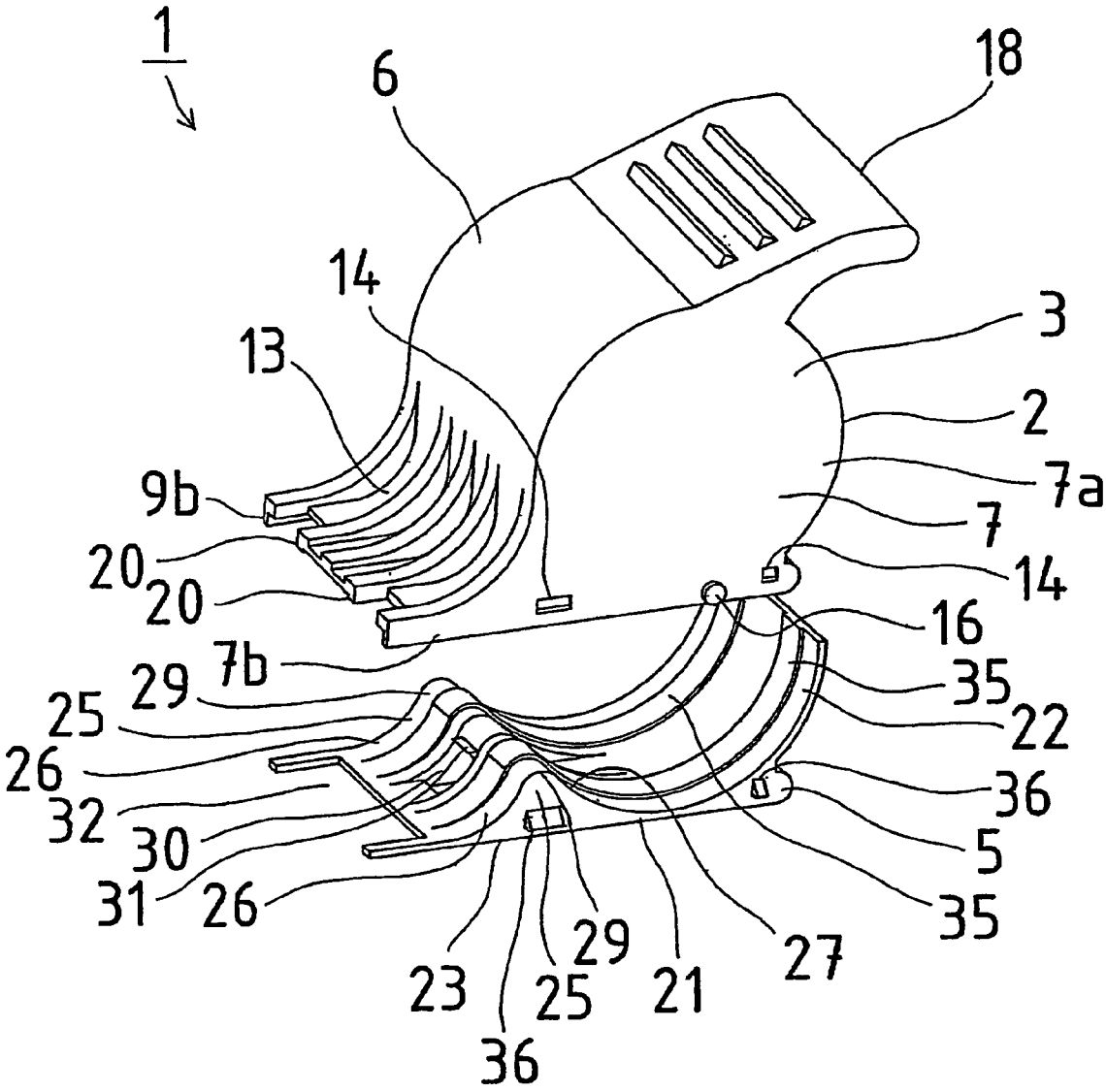
FIG. 2 is an exploded perspective view of FIG. 1.
Figure 3:
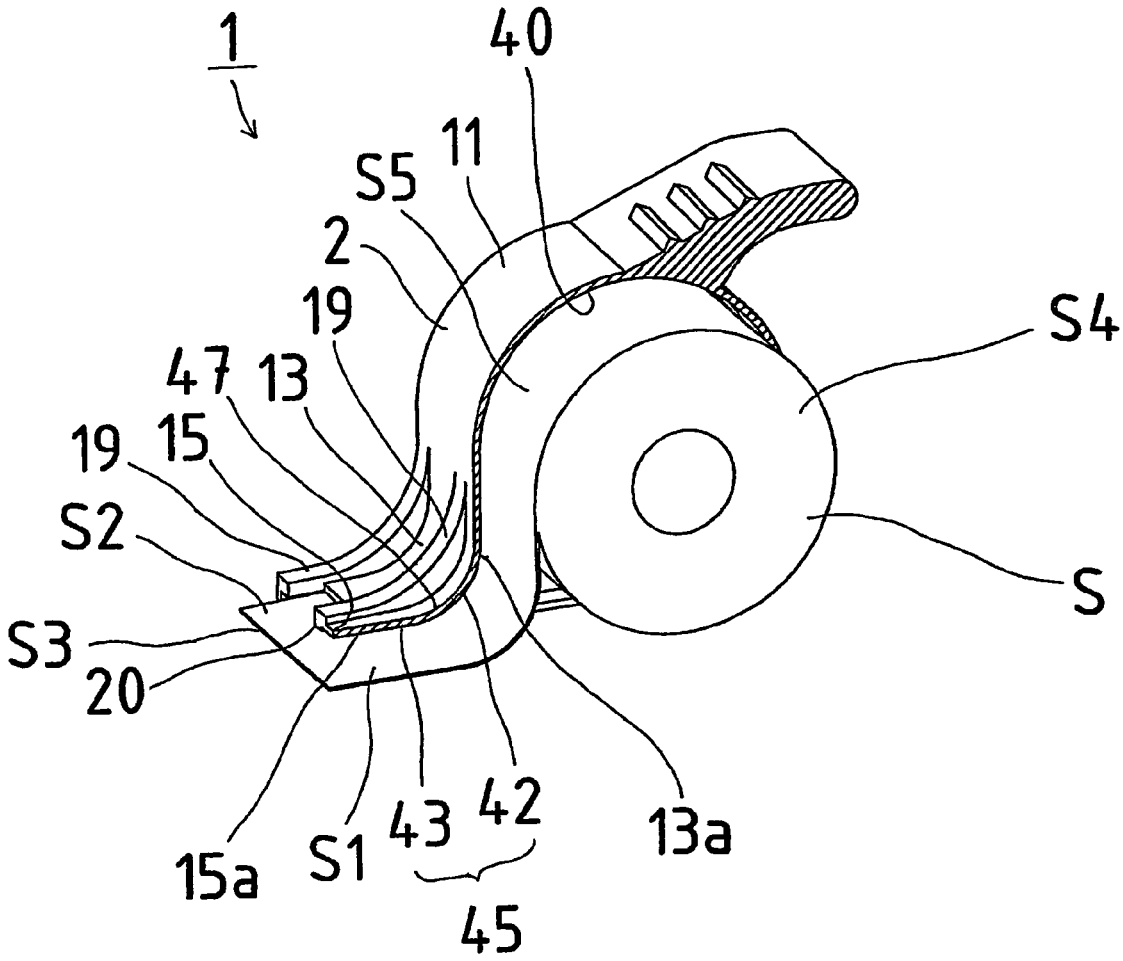
FIG. 3 is a sectional perspective view of FIG. 1.
Figure 4:
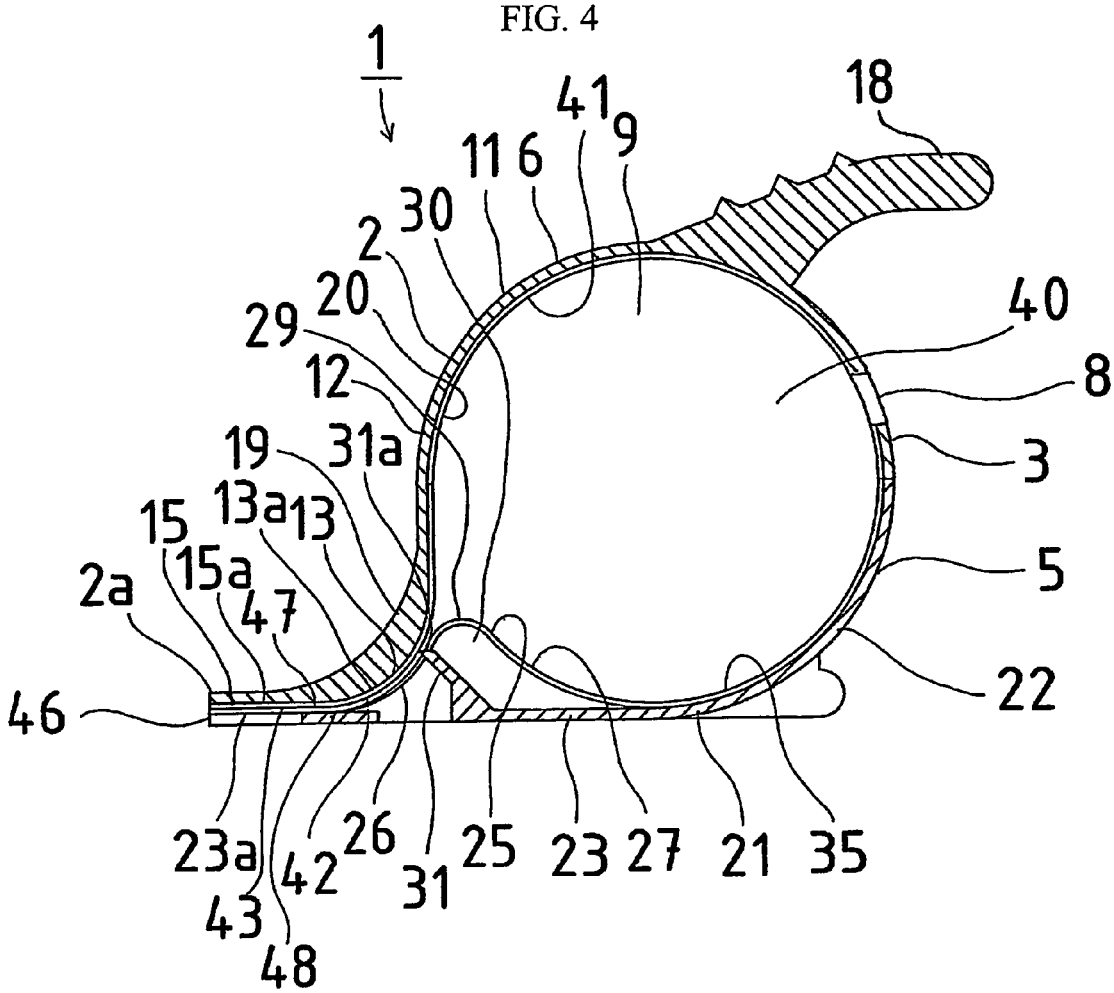
FIG. 4 is a sectional side view of FIG. 1.
Figure 5:
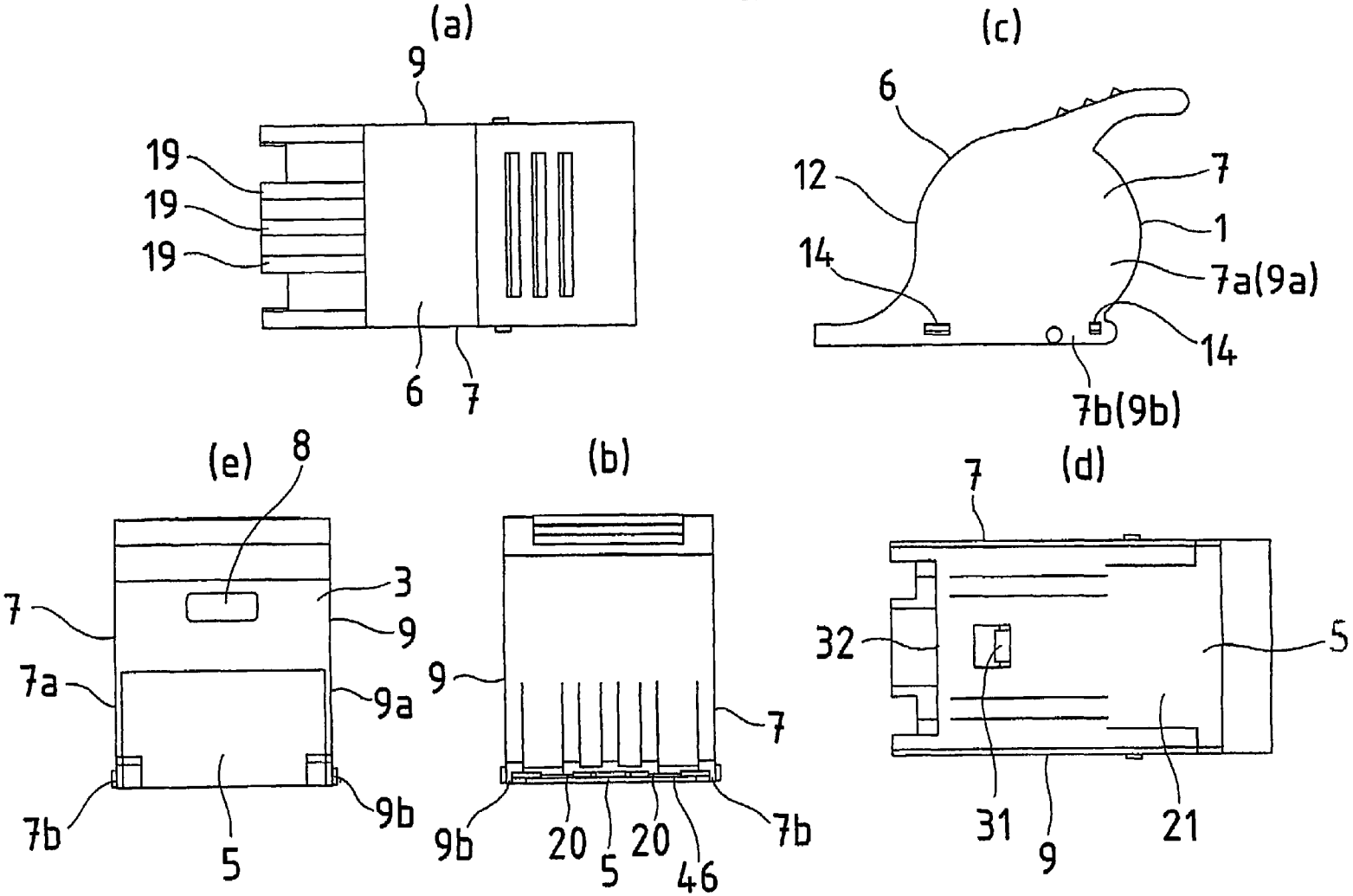
FIG. 5 is a six-side view of the staple refill of FIG. 1.
Figure 6:
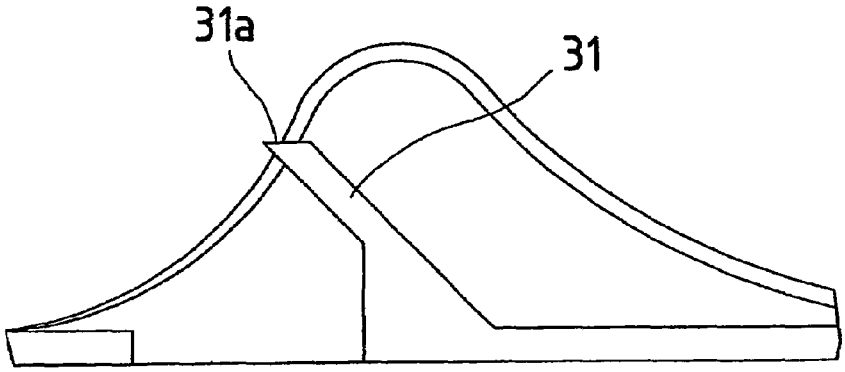
FIG. 6 is a sectional view showing a main part of FIG. 1.
Figure 6:
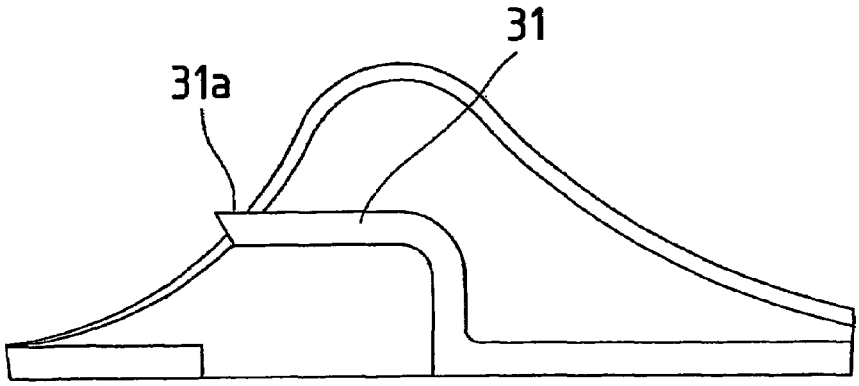
Figure 6:
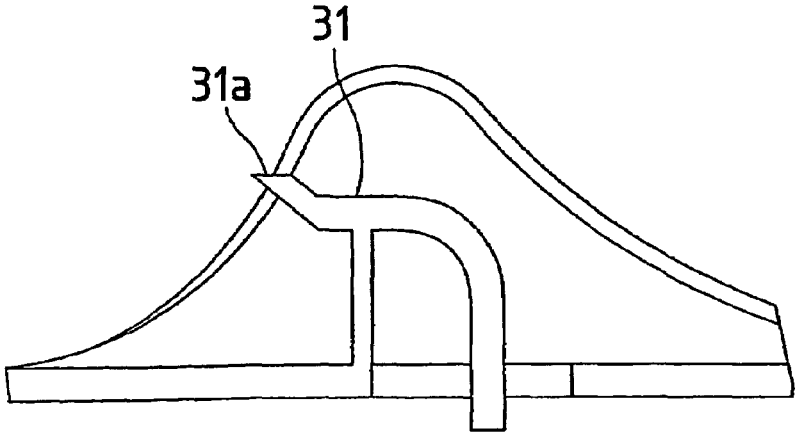
Figure 7:
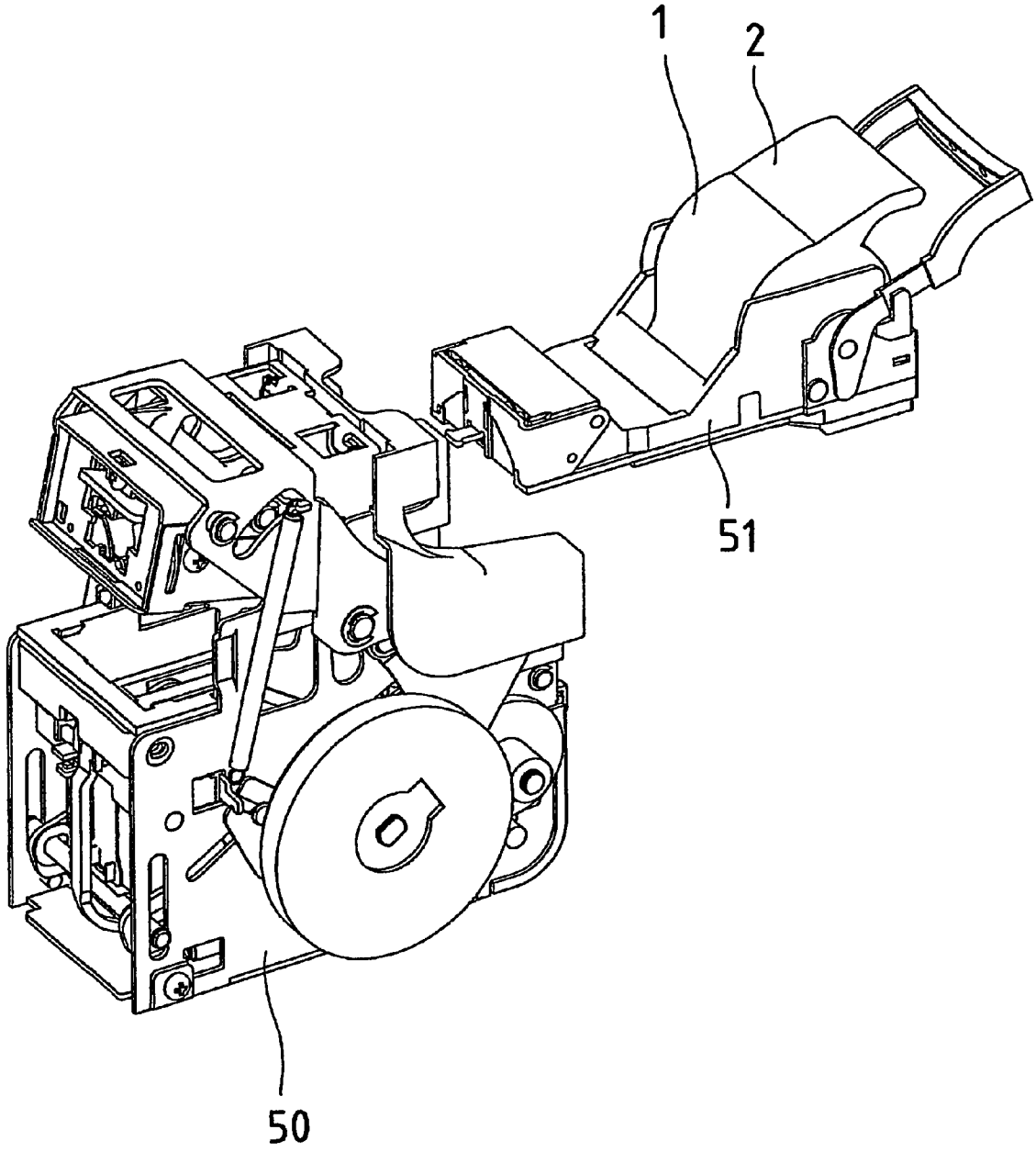
FIG. 7 is a perspective view showing a state in which the staple refill is attached to a cartridge of a stapler main body.
Figure 8:
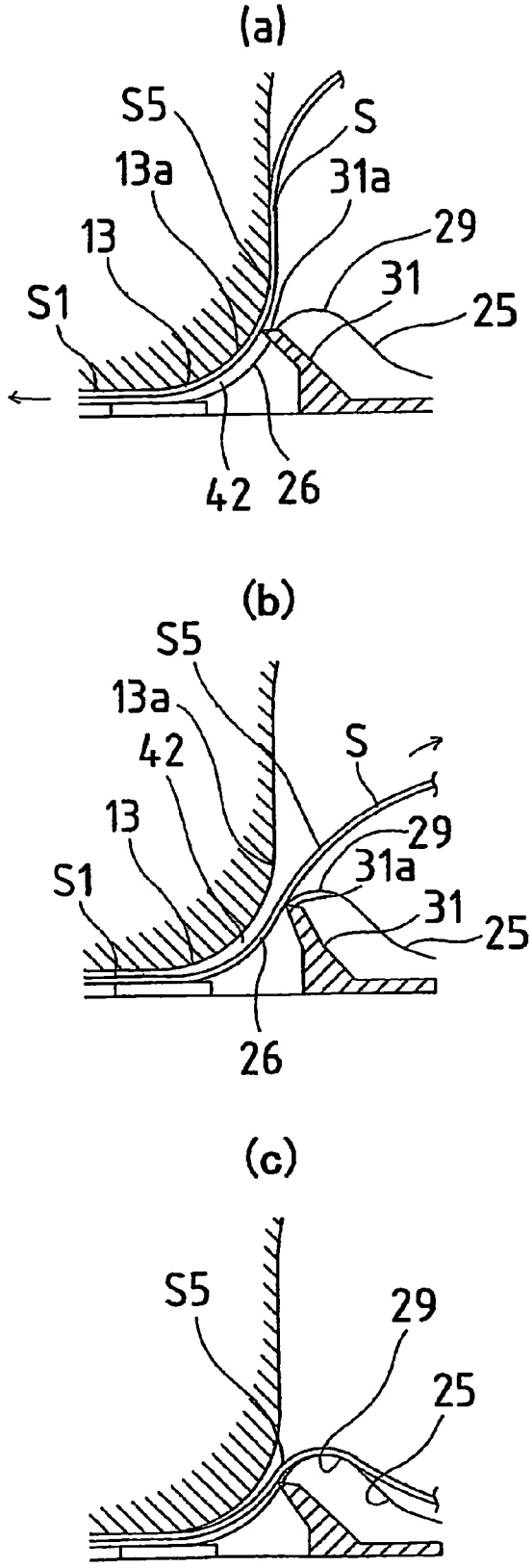
FIG. 8 is an explanatory view showing an operation of the staple refill according to the invention.
Figure 9:
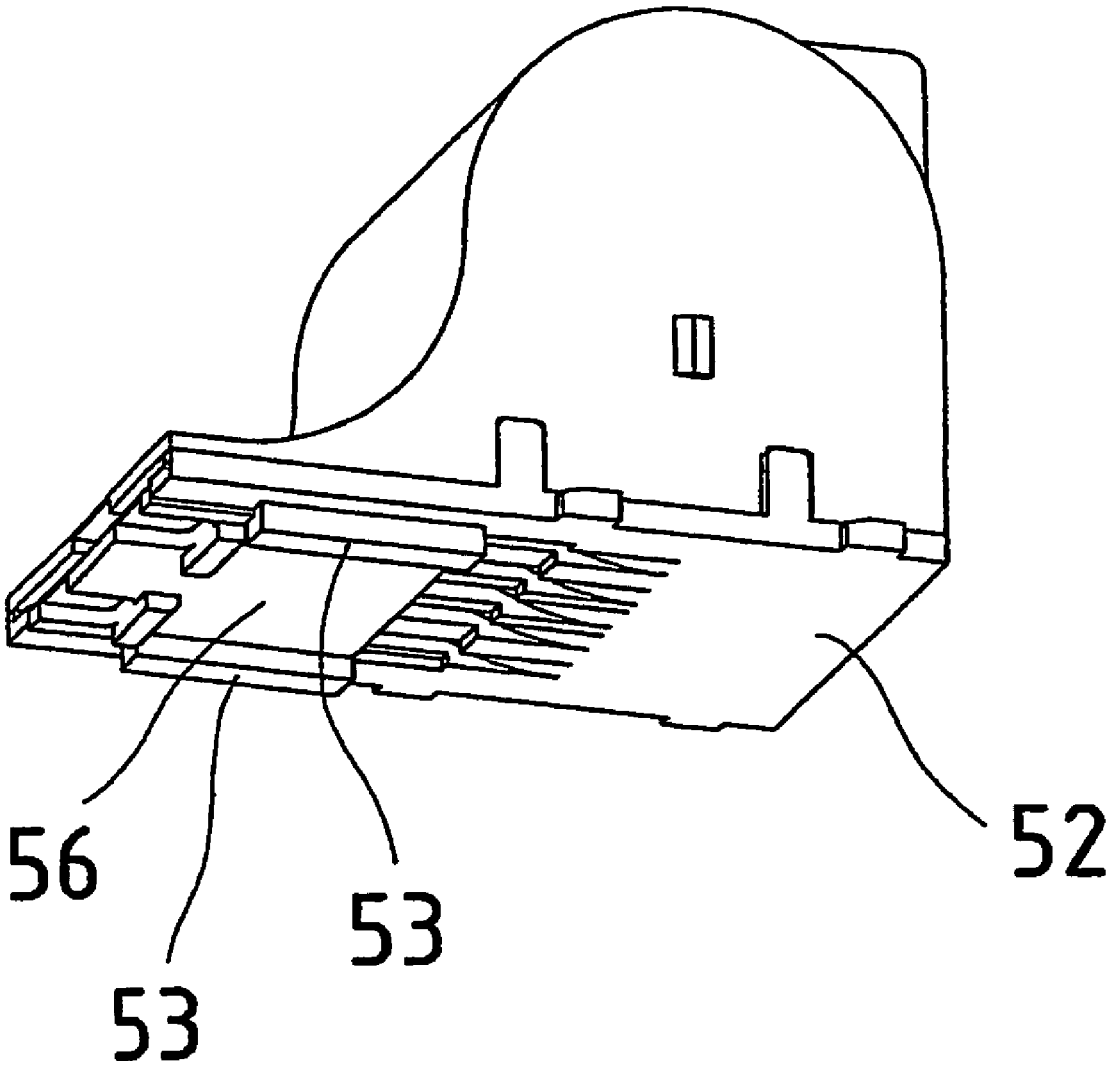
FIG. 9 is an overall perspective view showing another embodiment of a staple refill according to the invention.
Figure 10:
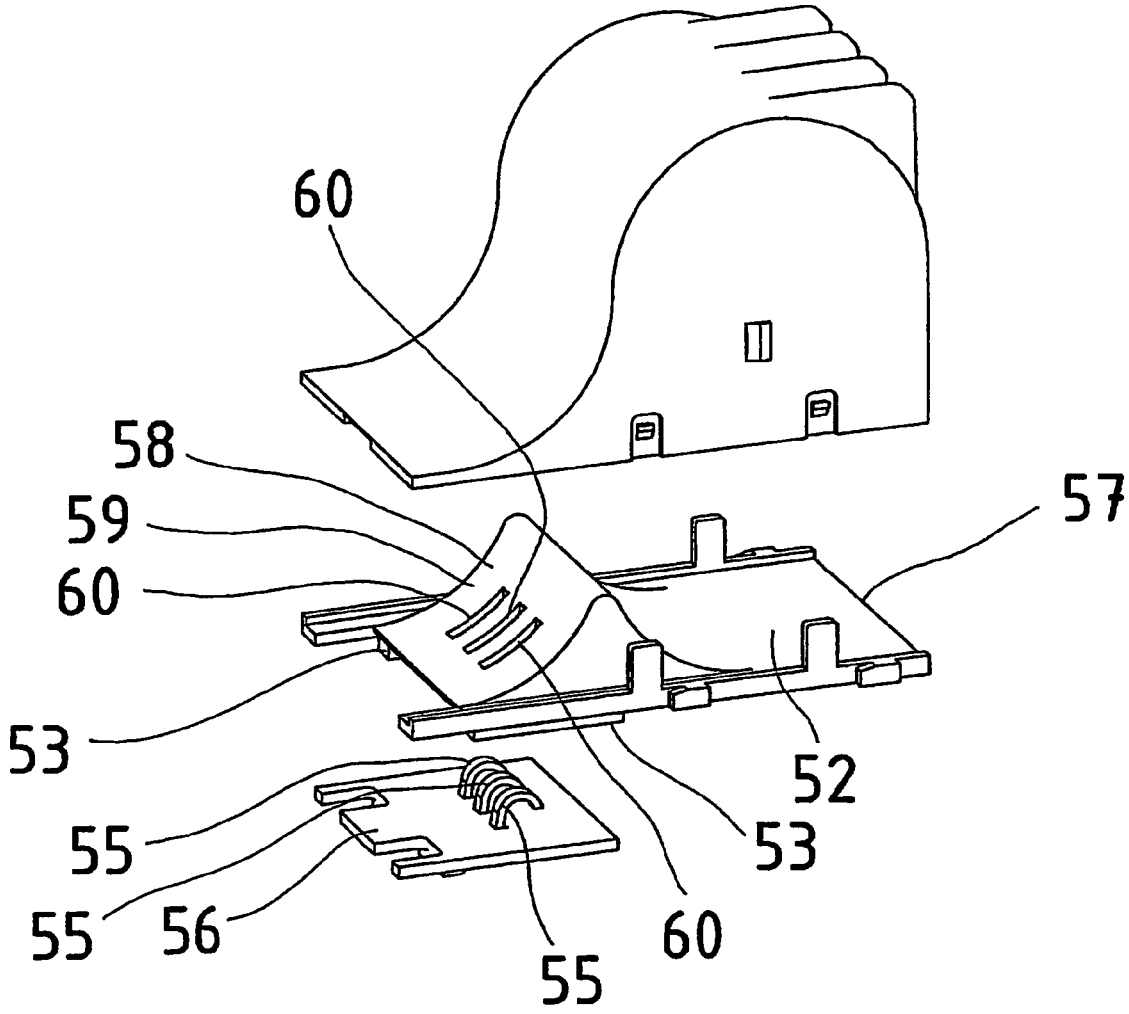
FIG. 10 is an exploded perspective view of FIG. 9.

Embodiments of a staple refill according to the invention will be described below with reference to FIGS. 1 to 10. FIG. 1 is an overall perspective view showing an embodiment of a staple refill according to the invention. FIG. 2 is an exploded perspective view of FIG. 1. FIG. 3 is a sectional perspective view of FIG. 1. FIG. 4 is a sectional side view of FIG. 1. FIG. 5 is a six-side view of the staple refill of FIG. 1, FIG. 5A is a top view when the staple refill is viewed from above, FIG. 5B is a front view when the staple refill is viewed from a front side, FIG. 5C is a side view when the staple refill is viewed from a side face, FIG. 5D is a bottom view when the staple refill is viewed from below, and FIG. 5E is a rear view when the staple refill is viewed from a rear side. FIG. 6 is a sectional view showing a main part of FIG. 1. FIG. 7 is a perspective view showing a state in which the staple refill is attached to a cartridge of a stapler main body. FIG. 8 is an explanatory view showing an operation of the staple refill according to the invention. FIG. 9 is an overall perspective view showing another embodiment of a staple refill according to the invention. FIG. 10 is an exploded perspective view of FIG. 9.

As shown in FIG. 7, a staple refill 1 is detachably attached to a stapler main body 50 or a cartridge 51 provided in the stapler main body 50. As shown in FIGS. 3 and 4, the staple refill 1 includes a storage portion 40, a discharge port 46, and a delivery passage 45. A sheet-like connected staple S wound in a roll shape is stored in the storage portion 40. The discharge port 46 discharges the sheet-like connected staple S stored in the storage portion 40. The delivery passage 45 delivers a leading end portion S1 of the sheet-like connected staple S stored in the storage portion 40 to a discharge port 46.

The delivery passage 45 is curved upward from the discharge port 46 toward the inside of the storage portion 40 so as to deliver the leading end portion S1, located on the upper side of the sheet-like connected staple S, to the discharge port 46. A backward movement preventing member 31 which prevents the sheet-like connected staple S from moving toward the side of the storage portion 40 is provided in the delivery passage 45. The backward movement preventing member 31 is integrated with the staple refill 1.

The backward movement preventing member 31 is formed such that a leading edge 31*a* slides on the side of a lower surface S3 of the sheet-like connected staple S to latch a connecting recess portion between the staples. The delivery passage 45 includes a first guide passage 43 and a second guide passage 42. The first guide passage 43 substantially formed in a linear shape is communicated with the discharge port 46. The second guide passage 42 curved upward is communicated with the storage portion 40. The backward movement preventing member 31 is provided in the second guide passage 42 while being exposed.

The delivery passage 45 includes an upper guide surface 47 and a lower guide surface 48. The upper guide surface 47 guides an upper surface S2 of the sheet-like connected staple S, and the lower guide surface 48 guides the lower surface S3 of the sheet-like connected staple S. An upper guide surface 13*a* of the second guide passage 42 is communicated with an inner surface 41 of the storage portion 40. A lower guide surface of the second guide passage 42 is formed by a curved surface 26 on the side of the discharge port 46. The curved surface 26 is included in a guide projection portion 25 projected in the storage portion 40. The backward movement preventing member 31 is formed so as to be projected from the surface 26 of the guide projection portion 25 on the side of the discharge port 46. A surface 27 of the guide projection portion 25 on the side of the storage portion 40 is curved so as to guide the sheet-like connected staple S stored in the storage portion 40.

Projection strips 20 and 35 are provided in an inner surface of the storage portion 40 of the staple refill 1. The projection strips 20 and 35 slides on the outer surface of the sheet-like connected staple S wound in a roll shape, and smoothly rotates the sheet-like connected staple S. An opening 8 communicated with the storage portion 40 is formed in the staple refill 1.

The staple refill will be described in detail. As shown in FIGS. 1 and 2, a refill 2 of the staple refill 1 includes an upper case 3 and a lower case 5 which is detachably fixed to the upper case 3. The upper case 3 is integrally formed by a synthetic resin, and includes an upper wall 6, a left wall 7 provided in the left end of the upper wall 6, and a right wall 9 provided in the right end of the upper wall 6.

The upper wall 6 includes an upper semi-cylindrical wall 11, a vertical wall 12 whose upper end is coupled to a front end of the upper semi-cylindrical wall 11, a curved wall 13 whose one end is coupled to a lower end of the vertical wall 12, and a horizontal wall 15 whose rear end is coupled to the other end of the curved wall 13. The left wall 7 and the right wall 9 include circular walls 7*a* and 9*a* and lower walls 7*b* and 9*b* respectively. The lower walls 7*b* and 9*b*, which extend substantially in a horizontal direction, are coupled to lower ends of the circular walls 7*a* and 9*a* respectively. The lower walls 7*b* and 9*b* are projected downward from the horizontal wall 15. Latch holes 14 and 14 are formed in the lower walls 7*b* and 9*b*.

A grip arm 18 extending backward is formed in the upper portion of the upper semi-cylindrical wall 11. A rib 19 reinforcing the curved wall 13 is formed in the upper surface of the curved wall 13. The opening 8 is formed in the rear portion of the upper semi-cylindrical wall 11. Further, the guide projection strip 20 guiding the sheet-like connected staple S is provided in the inner surface of the upper wall 6 of the upper case 3, i.e., in the inner surfaces of the upper semi-cylindrical wall 11, the vertical wall 12, the curved wall 13, and the horizontal wall 15.

As shown in FIGS. 3 and 4, similarly to the upper case 3, the lower case 5 is integrally formed by a synthetic resin, and includes a lower wall 21. The lower wall 21 includes an arc wall 22 and a linear wall 23. The arc wall 22 is formed in a quarter arc shape, and the rear end of the linear wall 23 is coupled to the front end of the arc wall 22. The mound-shaped guide projection 25 is formed in the linear wall 23. One surface 26 (on the side of the discharge port 46) of the guide projection (guide projection portion) 25 is curved such that a substantially constant gap is formed with a lower surface 13*a* of the curved wall 13 of the upper case 3. The other surface 27 (on the side of the storage portion 40) of the guide projection 25 is curved such that an arc is formed like the arc wall 22. A top portion 29 of the guide projection 25 is formed in a semi-circular shape.

A notch portion 30 is formed in a substantially intermediate portion of the guide projection 25. The pawl-shaped backward movement preventing member 31 is integrally provided in the linear wall 23. The backward movement preventing member 31 is located in the notch portion 30, and is projected from the curved one surface 26. In the linear wall 23, a substantially U-shaped notch recessed portion 32 is formed in the front portion, and the rear portion extends beyond the arc wall 22. The guide band (projection strip) 35 guiding the sheet-like connected staple S is projected in the inner surface of the lower wall 21 of the lower case 5, i.e., in the inner surfaces of the arc wall 22, the guide projection 25, and the linear wall 23. Latch pawls 36 and 36 are formed on both sides of the lower wall 21, and the latch pawls 36 and 36 are detachably latched in latch holes 14 and 14 of the upper case 3.

In the staple refill 1, when the lower case 5 is fitted between the lower wall 7*b* of the left wall 7 and the lower wall 9*b* of the right wall 9 of the upper case 3, the latch pawls 36 and 36 of the lower case 5 is latched in the latch holes 14 and 14 of the upper case 3 to assemble the refill 2. In the assembly, as shown in FIG. 3, the sheet-like connected staple S is placed in the lower case 5, when the sheet-like connected staple S is stored in the upper case 3 such that the leading end portion S1 of the sheet-like connected staple S wound counterclockwise is located in the upper portion of the upper case 3.

In the refill 2, the cylindrical storage chamber 40 is formed by the upper semi-cylindrical wall 11 and vertical wall 12 of the upper wall 6, the arc wall 22 and the other surface (on the side of the storage portion 40) 27 of the guide projection (guide projection portion) 25 of the lower case 5, and the left wall 7 and right wall 9. The sheet-like connected staple S is positioned on the lowest linear wall 23 by the arc wall 22 of the lower case 5 and the other surface 27 of the guide projection 25.

In the refill 2, the second guide passage 42 curved smoothly upward is formed by the lower surface 13*a* of the curved wall 13 of the upper case 3, one surface (on the side of the discharge port 46) 26 of the guide projection 25 of the lower case 5, the left wall 7 and right wall 9. The second guide passage 42 is upwardly curved toward the side of the storage portion 40, and is communicated with the storage portion 40. In the refill 2, the substantially linear first guide passage 43 is formed by a lower surface 15*a* of the horizontal wall 15 of the upper case 3, an upper surface 23*a* of the linear wall 23 of the lower case 5, the left wall 7 and right wall 9. That is, the delivery passage 45 is formed by the first guide passage 43 and the second guide passage 42. The discharge port 46 is formed at the front end of the delivery passage 45, and the sheet-like connected staple S is sequentially discharged from the leading end portion S1.

The delivery passage 45 includes the upper guide surface 47 guiding the upper surface S2 of the sheet-like connected staple S and the lower guide surface 48 guiding the lower surface S3 of the sheet-like connected staple S. The upper guide surface 47 is formed by the lower surface 15*a* of the horizontal wall 15 of the upper case 3 and the lower surface 13*a* of the curved wall 13 of the uppercase 3. The lower guide surface 48 is formed by the upper surface 23*a* of the linear wall 23 of the lower case 5 and one surface (on the side of the discharge port 46) 26 of the guide projection 25. On the upper guide surface 47 of the delivery passage 45, the two guide projection strips 20 are provided along a moving direction of the sheet-like connected staple S. The guide projection strip 20 is a strip-shaped projection portion which is slightly projected from the upper guide surface 47 toward the side of the sheet-like connected staple S. The guide projection strip 20 decreases a contact area between the upper guide surface 47 and the sheet-like connected staple S to decrease slide resistance in moving the sheet-like connected staple S, and thereby the sheet-like connected staple S is smoothly drawn forth. The notch recessed portion 32 is provided at a position facing the horizontal wall 15 of the upper guide surface 47 of the lower guide surface 48. The notch recessed portion 32 is a portion which brings a feeding pawl (feeding roller) of the stapler main body 50 into contact with the lower surface S3 of the sheet-like connected staple S. The sheet-like connected staple S is drawn from the storage portion 40 by the notch recessed portion 32, and is delivered to the discharge port 46.

The backward movement preventing member 31 is projected toward the inside of the second guide passage 42, and a leading edge 31*a* extends to a neighborhood of the lower surface 13*a* of the curved wall 13. The backward movement preventing member 31 can be bent due to elasticity of the synthetic resin material. The leading edge 31*a* of the backward movement preventing member 31 slides on the lower surface S3 of the sheet-like connected staple S to latch the connecting recess portion between the staples of the sheet-like connected staple S, which prevents the backward movement of the sheet-like connected staple S towards the side of the storage portion 40. The shape of the backward movement preventing member 31 is not particularly limited. For example, the backward movement preventing member 31 can obliquely be provided as shown in FIG. 6A, the backward movement preventing member 31 can be provided in a substantially L-shape as shown in FIG. 6B, and the backward movement preventing member 31 can be provided in a substantially n-shape as shown in FIG. 6C. As described above, the backward movement preventing member 31 is formed in a pawl shape, and the leading edge 31*a* strongly presses the sheet-like connected staples (particularly drawn-forth portion S5) against the side of the lower surface 13*a* of the curved wall 13 during transportation. Therefore, there is no possibility that the sheet-like connected staple S is drawn from the staple refill 1 due to the excessive shock or the like. In the case where the staple refill 1 is set, the portion projected from the lower wall 21 is returned into the refill, which rotates the backward movement preventing member 31 counterclockwise. The rotation of the sheet-like connected staple S slightly retreats the leading edge 31*a* of the backward movement preventing member 31 from the lower surface 13*a* of the curved wall 13 to decrease the pressing force to the sheet-like connected staple S. Therefore, moving resistance of the sheet-like connected staple S toward the feeding direction is decreased to perform the staple feeding more smoothly.

A leading tape (not shown) provided in the leading end portion S1 of the sheet-like connected staple S is drawn from the discharge port 46. When the leading tape is pulled, the sheet-like connected staple S provided in the storage chamber 40 of the staple refill 1 is rotated and the leading edge of the leading tape is located at the discharge port 46. The staple refill 1 is attached to the cartridge 51 which is detachably mounted to the stapler main body 50, and the cartridge 51 is mounted to the stapler main body 50. When the stapler main body 50 is driven, the leading end portion S1 of the sheet-like connected staple S is intermittently drawn toward the driver side by feeding means (for example, feeding pawl and feeding roller). A roll winding portion S4 of the sheet-like connected staple S is not placed on a drawn-forth portion S5, which decreases a load on the feeding means. The whole outer surfaces of the roll winding portion S4 of the sheet-like connected staple S do not come into contact with the inner surface of the storage chamber (storage portion) 40, but a part of the roll winding portion S4 comes into contact with the guide projection strip 20 and/or the guide band (projection strip) 35, so that the contact area is small. Therefore, frictional resistance is decreased, which further decreases the load on the feeding means.

When the leading end portion S1 of the sheet-like connected staple S is drawn by the feeding means of the stapler main body 50, as shown in FIG. 8A, the drawn-forth portion S5 is brought into close contact with the upper guide surface (the lower surface 13*a* of the curved wall 13) of the delivery passage 45, and the leading edge 31*a* of the backward movement preventing member 31 slides slightly on the drawn-forth portion S5 of the sheet-like connected staple S. Therefore, the sheet-like connected staple S can securely be delivered while little load is applied onto the feeding means. When the leading end portion S1 of the sheet-like connected staple S is returned by a weight of the roll winding portion S4 in the storage portion 40, as shown in FIG. 8B, the drawn-forth portion S5 comes into close contact with one surface 26 of the guide projection 25, and the leading edge 31*a*, projected from one surface 26, of the backward movement preventing member 31 securely latches the sheet-like connected staple S.

In the staple refill 1, the roll winding portion S4 is decreased as the sheet-like connected staple S is drawn. As shown in FIG. 8C, the sheet-like connected staple S is delivered to the delivery passage 45 after the drawn-forth portion S5 of the sheet-like connected staple S is lifted by the top portion 29 of the guide projection 25, so that the staple refill 1 also functions as described above. The top portion 29 of the guide projection 25 is formed in a semi-circular shape, so that the guide projection 25 can smoothly guide the sheet-like connected staple S.

Thus, the staple refill 1 can store the sheet-like connected staple S wound in a roll shape in the storage portion 40 of the refill 2 while the leading end portion S1 is placed in the upper portion of the storage portion 40, and the roll winding portion S4 is not placed on the drawn-forth portion S5 when the sheet-like connected staple S is delivered from the discharge port 46. Therefore, the load applied onto the feeding means is decreased.

In the conventional staple refill, a backward movement preventing member slides on a linearly extended portion of the sheet-like connected staple, and it is difficult to adjust contact pressure of the backward movement preventing member in the slide. On the contrary, in the staple refill 1, since the curved delivery passage 45 is utilized as described above, the drawing-forth of the sheet-like connected staple differs from the drawing-back of the sheet-like connected staple in the latching force of the backward movement preventing member 31, and the latching force of the backward movement preventing member 31 is increased in drawing back the sheet-like connected staple rather than in drawing forth the sheet-like connected staple. Therefore, it is not necessary to adjust the contact pressure of the backward movement preventing member 31.

In the staple refill 1, similarly to the feeding means of the stapler main body 50, the backward movement preventing member 31 is pressed to latch the lower surface S3 of the sheet-like connected staple S, where a bonding agent is not applied and a bonding tape does not adhere in a lengthwise direction. Therefore, the backward movement of the sheet-like connected staple S can securely be prevented, and the backward movement preventing member 31 can be arranged substantially in the center of the lower surface S3, so that the sheet-like connected staple S can be latched in a well-balanced manner.

In the staple refill 1, since the backward movement preventing member 31 is integrally formed, it is not necessary to install the backward movement preventing member made of a metal material in the refill unlike the conventional staple refill. Therefore, the assembly of the staple refill 1 can easily be performed, and weight reduction and cost reduction of the refill 2 can be achieved. Further, disposal of the staple refill 1 is easy to perform because it is not necessary to separate the staple refill 1 into each material.

In the refill 2, since the opening 8 is formed in the rear portion of the upper semi-cylindrical wall 11 as described above, the sheet-like connected staple S stored in the storage chamber 40 can be fixed so as not to move during the transportation by mounting a pressing member such as a cushion material from the opening 8 in packaging the staple refill 1, which allows the leading edge position of the sheet-like connected staple S not to be shifted. In the usage of the staple refill 1, a state such as a remaining amount of sheet-like connected staple S can also be confirmed by utilizing the opening 8.

In the staple refill 1, the backward movement preventing member 31 is integrated with the lower wall 21 of the lower case 5. Alternatively, as shown in FIGS. 9 and 10, substantially L-shaped engaging projections 53 and 53 are formed on both sides of a plate-shaped lower wall 52 of a lower case 57, and both ends of an insertion plate 56 including backward movement preventing members 55, which are formed substantially in an inverse U-shape and separately formed by a synthetic resin, are engaged to the engaging projections 53 and 53, and the backward movement preventing member 55 may be provided in the lower wall 52 of the lower case 57. The backward movement preventing members 55, which are formed substantially in an inverse U-shape, are projected from long holes 60 formed in one curved surface 59 of a substantially mound-shaped guide projection 58, and the backward movement preventing members 55 press the sheet-like connected staple S.

Effects of the Invention

In the staple refill according to the invention, the leading end portion of the sheet-like connected staple wound in a roll shape can be stored in the storage portion of the refill while the leading end portion is placed in the upper portion of the storage portion, and the sheet-like connected staple is not placed on the drawn-forth portion when the sheet-like connected staple is drawn to be delivered. Therefore, the staple refill of the invention has the effect that the load applied onto the feeding means is decreased. Further, in the staple refill according to the invention, the delivery passage is curved upward from the discharge port toward the inside of the storage portion, and the backward movement preventing member is provided in the curved delivery passage. Therefore, the latching force can be weakened in drawing forth the sheet-like connected staple, and the latching force can be strengthened in drawing back the sheet-like connected staple, so that the staple refill of the invention has the effect that the adjustment of the backward movement preventing member is not required.

In the staple refill according to the invention, the backward movement preventing member slides not on the upper surface where the bonding agent is applied and the bonding tape adheres, but on the lower surface of the sheet-like connected staple on the same side as the feeding means. Therefore, the backward movement preventing member is difficult to slide, so that the staple refill of the invention has the effect that the sheet-like connected staple can securely be latched. Further, since the backward movement preventing member can slide in the center of the lower surface of the sheet-like connected staple, so that the backward movement preventing member can be latched in a well-balanced manner in the sheet-like connected staple. Therefore, the staple refill of the invention has the effect that the possibility of the bending of the sheet-like connected staple can extremely be decreased. Furthermore, in the staple refill according to the invention, since the backward movement preventing member is integrated with the refill, it is not necessary to install the backward movement preventing member in the refill, so that the staple refill of the invention has the effect that the assembly of the staple refill can easily be performed.

In the staple refill according to the invention, the projection strip sliding on the outer surface of the sheet-like connected staple wound in a roll shape is provided in the inner surface of the storage portion, and the whole outer surfaces of the sheet-like connected staple do not come into contact with the bottom surface of the storage portion, but a part of the outer surface comes into contact with the bottom surface, so that the contact area is small. Therefore, the staple refill of the invention has the effect that the sheet-like connected staple can smoothly be rotated.

In the staple refill according to the invention, the opening communicated with the storage portion is formed in the refill, so that the staple refill of the invention has the effects that the pressing member such as the cushion material can be mounted by utilizing the opening in packaging the staple refill such that the sheet-like connected staple stored in the storage portion does not move during the transportation, the leading edge position of the sheet-like connected staple cannot be shifted, and a state such as a remaining amount of sheet-like connected staple can be confirmed by utilizing the opening.

Description of the Reference Numerals and Signs

S sheet-like connected staple
S1 leading end portion
S2 upper surface
S3 lower surface
S4 roll winding portion
S5 drawn-forth portion
1 staple refill
2 refill
3 upper case
5 lower case
6 upper wall
7 left wall
7*a* circular wall
7*b* lower wall
8 opening
9 right wall
9*a* circular wall
9*b* lower wall
11 upper semi-cylindrical wall
12 vertical wall
13 curved wall
13*a* lower surface (upper guide surface)
14 latch hole
15 horizontal wall
15*a* lower surface
18 grip arm
19 rib
20 guide projection strip
21 lower wall
22 arc wall
23 linear wall
23*a* upper surface
25 guide projection (guide projection portion)
26 one surface (lower guide surface)
27 the other surface
29 top portion
30 notch portion
31 backward movement preventing member
31*a* leading edge
32 notch recessed portion
35 guide band (projection strip)
36 latch pawl
40 storage chamber (storage portion)
42 second guide passage
43 first guide passage
45 delivery passage
46 discharge port
47 upper guide surface
48 lower guide surface
50 stapler main body
51 cartridge
52 lower wall
53 engaging projection
55 backward movement preventing member
56 insertion plate
57 lower case
58 guide projection
59 one surface
60 long hole

INDUSTRIAL APPLICABILITY

The invention can be applied to a motor-driven stapler with which a copying machine, a printing machine, and the like are equipped.

The invention claimed is:

1. A staple refill configured to be detachably attached to a stapler main body or a cartridge provided in a stapler main body, comprising:

a storage portion for storing a sheet of connected staples wound in a roll, the sheet of connected staples having an interior surface facing a center of the roll and an outer surface opposite the interior surface;

a discharge port for discharging the sheet of connected staples; and a delivery passage for delivering a leading end portion of the sheet of connected staples to the discharge port;

wherein the delivery passage is defined by a lower guide surface;

wherein the delivery passage is curved upward from said discharge port toward an inside portion of said storage portion and is configured to deliver the leading end portion of the sheet of connected staples to the discharge port;

a backward movement preventing member projecting from the lower guide surface for preventing the backward movement of the sheet of connected staples toward a storage portion side, the backward movement preventing member configured to enable the interior surface of the sheet of connected staples to slide in one direction on the backward movement preventing member, the interior surface of the sheet of connected staples being a side facing the lower guide surface.

2. A staple refill according to claim 1, wherein the backward movement preventing member is provided integrally on the staple refill.

3. A staple refill according to claim 2, wherein the backward movement preventing member is formed such that the interior surface side of the sheet of connected staples slide on a leading edge of the backward movement preventing member to latch a connecting recess portion between staples.

4. A staple refill according to claim 3, wherein the delivery passage is comprising a first guide passage communicating with the discharge port and formed in a substantially linear shape, and a second guide passage communicating with said storage portion and curved upward;

wherein the second guide passage is provided with the backward movement preventing member.

5. A staple refill according to claim 2, wherein the delivery passage is comprising a first guide passage communicating with the discharge port and formed in a substantially linear shape, and a second guide passage communicating with said storage portion and curved upward;

wherein the second guide passage is provided with the backward movement preventing member.

6. A staple refill according to claim 1, wherein the backward movement preventing member is formed such that the interior surface side of the sheet of connected staples slide on a leading edge of the backward movement preventing member to latch a connecting recess portion between staples.

7. A staple refill according to claim 6, wherein the delivery passage is comprising a first guide passage communicating with the discharge port and formed in a substantially linear shape, and a second guide passage communicating with said storage portion and curved upward;

wherein the second guide passage is provided with the backward movement preventing member.

8. A staple refill according to claim 1, wherein the delivery passage comprises a first guide passage communicating with the discharge port and formed in a substantially linear shape, and a second guide passage communicating with said storage portion and curved upward;

wherein the second guide passage is provided with the backward movement preventing member.

9. A staple refill according to claim 8, wherein the delivery passage is also defined by an upper guide surface for guiding an upper surface of the sheet of connected staples;

wherein the upper guide surface of the second guide passage is coupled to an inner surface of the storage portion;

wherein the lower guide surface of the second guide passage is formed by a curved surface on a discharge port side of a guide projection portion protruding in the storage portion.

10. A staple refill according to claim 9, wherein the backward movement preventing member is formed to protrude from a surface on a discharge port side of the guide projection portion.

11. A staple refill according to claim 10, wherein the surface on the discharge port side of the guide projection portion is formed in a curved shape for guiding the sheet of connected staples.

12. A staple refill according to claim 9, wherein the upper guide surface on the discharge port side of the guide projection portion is formed in a curved shape for guiding the sheet of connected staples.

13. The staple refill according to claim 1 wherein the storage portion is configured so that the sheet of connected staples are discharged by rotation in a direction downward and toward the discharge port.

14. A staple refill configured to be detachably attached to a stapler main body or a cartridge provided in a stapler main body comprising:

a storage portion for storing a sheet of connected staples wound in a roll, the sheet of connected staples having an interior surface facing a center of the roll and an outer surface opposite the interior surface;

a discharge port for discharging the sheet of connected staples, and;

a delivery passage configured to deliver a leading end portion of the sheet of connected staples to the discharge port;

wherein the delivery passage is defined by a lower guide surface;

wherein a backward movement preventing member projects from the lower guide surface for preventing the backward movement of the sheet of connected staples toward a storage portion side, the backward movement preventing member configured to enable the interior surface of the sheet of connected staples to slide in one direction on the backward movement preventing member, the interior surface of the sheet of connected staples being a side facing the lower guide surface;

wherein a projection strip is provided in an inner surface of the storage portion to enable the outer surface of the sheet of connected staples wound in a roll shape to slide thereon for smooth rotation of the sheet of connected staples.

15. The staple refill according to claim 14 wherein the storage portion is configured so that the sheet of connected staples are discharged by rotation in a direction downward and toward the discharge port.

16. A staple refill configured to be detachably attached to a stapler main body or a cartridge provided in a stapler main body comprising:

a storage portion for storing a sheet of connected staples wound in a roll;

a discharge port for discharging the sheet of connected staples, the sheet of connected staples having an interior surface facing a center of the roll and an outer surface opposite the interior surface, and;

a delivery passage configured to deliver a leading end portion of the sheet of connected staples to the discharge port;

wherein the delivery passage is defined by a lower guide surface;

an opening communicating with the storage portion; and a backward movement preventing member projects from the lower guide surface for preventing the backward movement of the sheet of connected staples toward a storage portion side, the backward movement preventing member configured to enable the interior surface of the sheet of connected staples to slide in one direction on the backward movement preventing member, the interior surface of the sheet of connected staples being a side facing the lower guide surface.

17. The staple refill according to claim 16 wherein the storage portion is configured so that the sheet of connected staples are discharged by rotation in a direction downward and toward the discharge port.

18. A staple refill configured to be detachably attached to a stapler main body or a cartridge provided in a stapler main body, comprising:

a storage portion for storing a sheet of connected staples wound in a roll, the sheet of connected staples having an interior surface facing a center of the roll and an outer surface opposite the interior surface;

a discharge port for discharging the sheet of connected staples; and a delivery passage for delivering a leading end portion of the sheet of connected staples to the discharge port;

wherein the delivery passage is curved and extends from said discharge port toward an inside portion of said storage portion;

the delivery passage includes a first surface arranged to face the outer surface of the sheet of connected staples as the sheet of connected staples passes through the delivery passage and a second surface arranged to face the interior surface of the sheet of connected staples as the sheet of connected staples passes through the delivery passage, wherein a majority of the first surface is between the delivery passage and the center of the roll; and a backward movement preventing member is provided inside the delivery passage for preventing the backward movement of the sheet of connected staples toward a storage portion side, the backward movement preventing member configured to enable the interior surface of the sheet of connected staples to slide in one direction on the backward movement preventing member.

* * * * *